US006387153B1

(12) United States Patent
Burke

(10) Patent No.: US 6,387,153 B1
(45) Date of Patent: May 14, 2002

(54) STABLE IDLE PROCEDURE

(75) Inventor: Peter Damian Burke, Winthrop (AU)

(73) Assignee: Technological Resources Pty Ltd, Melbourne (AU)

( * ) Notice: Subject to any disclaimer, the term of this patent is extended or adjusted under 35 U.S.C. 154(b) by 0 days.

(21) Appl. No.: 09/685,488

(22) Filed: Oct. 10, 2000

(30) Foreign Application Priority Data

Oct. 15, 1999 (AU) ..... PQ3463

(51) Int. Cl.[7] ..... C22C 5/32

(52) U.S. Cl. ..... 75/502; 75/504; 75/531; 75/549

(58) Field of Search ..... 75/502, 504, 531, 75/549

(56) References Cited

U.S. PATENT DOCUMENTS

| | | | |
|---|---|---|---|
| 2,647,045 | A | 7/1953 | Rummel |
| 3,844,770 | A | 10/1974 | Nixon |
| 3,845,190 | A | 10/1974 | Yosim et al. |
| 3,888,194 | A | 6/1975 | Kishigami et al. |
| 3,890,908 | A | 6/1975 | von Klenck et al. |
| 3,894,497 | A | 7/1975 | Helke et al. |
| 4,007,034 | A | 2/1977 | Hartwig et al. |
| 4,053,301 | A | 10/1977 | Stephens, Jr. |
| 4,145,396 | A | 3/1979 | Grantham |
| 4,177,063 | A | 12/1979 | Dickson |
| 4,207,060 | A | 6/1980 | Zangs |
| 4,356,035 | A | 10/1982 | Brotzmann et al. |
| 4,389,043 | A | 6/1983 | Weber et al. |
| 4,400,936 | A | 8/1983 | Evans |
| 4,402,274 | A | 9/1983 | Meenan et al. |
| 4,431,612 | A | 2/1984 | Bell et al. |
| 4,447,262 | A | 5/1984 | Gay et al. |
| 4,456,017 | A | 6/1984 | Wunsche |
| 4,468,298 | A | 8/1984 | Byrne et al. |

(List continued on next page.)

FOREIGN PATENT DOCUMENTS

| | | |
|---|---|---|
| AU | A-23864/84 | 7/1984 |
| AU | B-41064/85 | 4/1986 |
| AU | B-69707/87 | 9/1987 |
| AU | B-22448/88 | 5/1989 |
| AU | B-26831/88 | 7/1989 |
| AU | B-28802/89 | 8/1989 |
| AU | A-42859/89 | 4/1990 |
| AU | A-49307/90 | 9/1990 |

(List continued on next page.)

OTHER PUBLICATIONS

U.S. application No. 09/550,421, Dry, filed Apr. 17, 2000.
U.S. application No. 09/160,913, Dry, filed Sep. 25, 1998.
U.S. application No. 09/331,277, Jai, filed Jun. 17, 1999.
U.S. application No. 09/331,272, Bates, filed Jun. 17, 1999.
U.S. application No. 09/509,314, Bates, filed Mar. 21, 2000.

(List continued on next page.)

*Primary Examiner*—Roy King
*Assistant Examiner*—Tima McGuthry-Banks
(74) *Attorney, Agent, or Firm*—Merchant & Gould, P.C.

(57) ABSTRACT

A procedure for holding production of molten metal in a direct smelting process is disclosed. In situations where it is necessary to hold metal production and there is a continuing available supply of oxygen-containing gas and solid carbonaceous material, the hold procedure includes the steps of stopping supply of metalliferous feed material, continuing to inject oxygen-containing gas and solid carbonaceous material into the vessel and generating heat within the vessel to maintain the temperature of the molten bath above a temperature at which the bath freezes. In situations where it is necessary to hold production and there is a continuing supply of oxygen-containing gas but no available solid carbonaceous material, the hold procedure includes the steps of stopping supply of metalliferous feed material and injecting oxygen-containing gas and gaseous or liquid combustible material into the vessel and generating heat within the vessel to maintain the bath temperature.

17 Claims, 1 Drawing Sheet

U.S. PATENT DOCUMENTS

| | | | |
|---|---|---|---|
| 4,468,299 | A | 8/1984 | Byrne et al. |
| 4,468,300 | A | 8/1984 | Byrne et al. |
| 4,481,891 | A | 11/1984 | Takeshita et al. |
| 4,504,043 | A | 3/1985 | Yamaoka et al. |
| 4,511,396 | A | 4/1985 | Nixon |
| 4,565,574 | A | 1/1986 | Katayama et al. |
| 4,566,904 | A | 1/1986 | von Bogdandy et al. |
| 4,572,482 | A | 2/1986 | Bedell |
| 4,574,714 | A | 3/1986 | Bach et al. |
| 4,602,574 | A | 7/1986 | Bach et al. |
| 4,664,618 | A | 5/1987 | Gitman |
| 4,681,599 | A | 7/1987 | Obkircher |
| 4,684,448 | A | 8/1987 | Itoh et al. |
| 4,701,214 | A | 10/1987 | Kaneko et al. |
| 4,718,643 | A | 1/1988 | Gitman |
| 4,786,321 | A | 11/1988 | Hoster et al. |
| 4,790,516 | A | 12/1988 | Sugiura et al. |
| 4,798,624 | A | 1/1989 | Brotzmann et al. |
| 4,804,408 | A | 2/1989 | Puhringer |
| 4,849,015 | A | 7/1989 | Fassbinder et al. |
| 4,861,368 | A | 8/1989 | Brotzmann et al. |
| 4,874,427 | A | 10/1989 | Hamada et al. |
| 4,890,562 | A | 1/1990 | Gitman |
| 4,913,734 | A | 4/1990 | Romenets et al. |
| 4,923,391 | A | 5/1990 | Gitman |
| 4,940,488 | A | 7/1990 | Maeda et al. |
| 4,946,498 | A | 8/1990 | Weber |
| RE33,464 | E | 11/1990 | Gitman |
| 4,976,776 | A | 12/1990 | Elvander et al. |
| 4,999,097 | A | 3/1991 | Sadoway |
| 5,005,493 | A | 4/1991 | Gitman |
| 5,024,737 | A | 6/1991 | Claus et al. |
| 5,037,808 | A | 8/1991 | Tarcy et al. |
| 5,042,964 | A | 8/1991 | Gitman |
| 5,050,848 | A | 9/1991 | Hardie et al. |
| 5,051,127 | A | 9/1991 | Hardie et al. |
| 5,065,985 | A | 11/1991 | Takahashi et al. |
| 5,177,304 | A | 1/1993 | Nagel |
| 5,191,154 | A | 3/1993 | Nagel |
| 5,222,448 | A | 6/1993 | Morgenthaler et al. |
| 5,238,646 | A | 8/1993 | Tarcy et al. |
| 5,271,341 | A | 12/1993 | Wagner |
| 5,279,715 | A | 1/1994 | La Camera et al. |
| 5,301,620 | A | 4/1994 | Nagel et al. |
| 5,302,184 | A | 4/1994 | Batterham et al. |
| 5,322,547 | A | 6/1994 | Nagel et al. |
| 5,332,199 | A | 7/1994 | Knapp et al. |
| 5,333,558 | A | 8/1994 | Lees, Jr. |
| 5,396,850 | A | 3/1995 | Conochie et al. |
| 5,401,295 | A | 3/1995 | Brotzman |
| 5,407,461 | A | 4/1995 | Hardie et al. |
| 5,415,742 | A | 5/1995 | La Camera et al. |
| 5,443,572 | A | 8/1995 | Wilkison et al. |
| 5,480,473 | A | 1/1996 | Hardie et al. |
| 5,489,325 | A | 2/1996 | Keogh et al. |
| 5,498,277 | A | 3/1996 | Floyd et al. |
| 5,518,523 | A | 5/1996 | Brotzmann |
| 5,529,599 | A | 6/1996 | Calderon |
| 5,613,997 | A | 3/1997 | Satchell, Jr. |
| 5,630,862 | A | 5/1997 | Greenwalt |
| 5,640,708 | A | 6/1997 | Conochie et al. |
| 5,647,888 | A | 7/1997 | Keogh et al. |
| 5,683,489 | A | 11/1997 | Hayashi et al. |
| 5,741,349 | A | 4/1998 | Hubble et al. |
| 5,800,592 | A | 9/1998 | den Hartog et al. |
| 5,802,097 | A | 9/1998 | Gensini et al. |
| 5,869,018 | A | 2/1999 | Stephens, Jr. |
| 5,871,560 | A | 2/1999 | Fluch et al. |
| 4,940,488 | C1 | 8/1999 | Maeda et al. |
| 5,938,815 | A | 8/1999 | Satchell, Jr. |
| 6,083,296 | A * | 7/2000 | Innes et al. ..... 75/502 |

FOREIGN PATENT DOCUMENTS

| | | |
|---|---|---|
| AU | A-49309.90 | 9/1990 |
| AU | B-74840/91 | 8/1992 |
| AU | B-90957/91 | 8/1992 |
| AU | A-48938/93 | 4/1994 |
| AU | B-48937/93 | 5/1994 |
| AU | B-50820/96 | 1/1997 |
| DE | 3139375 | 4/1973 |
| DE | 3244744 | 5/1984 |
| EP | 079 182 A1 | 5/1983 |
| EP | 084 288 A1 | 7/1983 |
| EP | 422 309 A1 | 4/1991 |
| EP | 541 269 A1 | 5/1993 |
| EP | 592 830 A1 | 4/1994 |
| EP | 657 550 | 6/1995 |
| GB | 2 043 696 A | 10/1980 |
| GB | 2 088 892 A | 6/1982 |
| WO | WO 89/01981 | 3/1989 |
| WO | WO 92/12265 | 7/1992 |
| WO | WO 93/06251 | 4/1993 |
| WO | WO 94/19497 | 9/1994 |
| WO | WO 96/19591 | 6/1996 |
| WO | WO 96/31627 | 10/1996 |
| WO | WO 97/17473 | 5/1997 |
| WO | WO 97/20958 | 6/1997 |
| WO | WO 97/23656 | 7/1997 |
| WO | WO 98/27232 | 6/1998 |
| WO | WO 98/27239 | 6/1998 |
| WO | WO 99/16911 | 4/1999 |

OTHER PUBLICATIONS

U.S. application No. 09/535,665, Leigh, filed Mar. 21, 2000.

U.S. application No. 09/462,282, McCarthy, filed Mar. 16, 2000.

U.S. application No. 09/478,750, Dry, filed Jan. 6, 2000.

U.S. application No. 09/509,286, MCarthy, filed Mar. 21, 2000.

U.S. application No. 09/509,264, Dry, filed Mar. 21, 2000.

U.S. application No. 09/509,290, Dry, filed Mar. 21, 2000.

U.S. application No. 09/509,323, Dry, filed Mar. 21, 2000.

U.S. application No. 09/587,774, Bates, filed Jun. 6, 2000.

U.S. application No. 09/611,514, Bates, filed Jul. 7, 2000,

U.S. application No. 09/632,730, Dry, filed Aug. 4, 2000.

U.S. application No. 09/634,059, Burke, filed Aug. 9, 2000.

U.S. application No. 09/669,397, Batterham, filed Sep. 26, 2000.

U.S. application No. 09/662,821, Dry, filed Oct. 12, 2000.

Patent Abstract of Japan, JP, A, 10–280020 (Nippon Steel Corp.), Oct. 20, 1998.

Patent Abstracts of Japan, C–951, p. 24, JP, A, 04–63218, (Kawasaki Heavy Ind. Ltd), Feb. 28, 1992.

Patent Abstracts of Japan, C–627, p. 109, Jp, A, 01–127613 (Kawasaki Steel Corp.), May 19, 1989.

Patent Abstracts of Japan, C–951, JP, A, 4–63217 (Kawasaki Heavy Ind. Ltd.), Feb. 28, 1992.

Patent abstracts of Japan, C–497, p. 115, JP, A, 62–280315 (Nippon Kokan K.K.), Dec. 15, 1987.

Derwent Abstract Accession No. 87–039748/06 Class Q77, JP, A, 61–295334, Dec. 26, 1986.

* cited by examiner

STABLE IDLE PROCEDURE

FIELD OF THE INVENTION

The present invention relates to a process for producing molten iron from a metalliferous feed material, such as ores, partly reduced ores, and metal-containing waste streams, in a metallurgical vessel containing a molten bath.

The present invention relates particularly to a molten bath-based direct smelting process for producing molten iron from a metalliferous feed material.

BACKGROUND

The term "direct smelting process" is understood to mean a process that produces a molten metal, in this case iron, from a metalliferous feed material.

The present invention relates more particularly to a molten bath-based direct smelting process that is generally referred to as the HIsmelt process.

In general terms, the HIsmelt process includes thesteps of:

(a) forming a molten bath having a metal layer and a slag layer on the metal layer in a direct melting vessel;

(b) injecting metalliferous feed material and solid carbonaceous material, and optionally fluxes, into the metal layer via a plurality of lances/tuyeres;

(c) smelting metalliferous feed material to metal in the metal layer;

(d) causing molten material to be protected as splashes, droplets, and streams into a space above a nominal quiescent surface of the molten bath to form a transition zone; and (e) injecting an oxygen-containing gas into the vessel via one or more than one lance/tuyere to post-combust reaction gases released from the molten bath, whereby the ascending and thereafter descending splashes, droplets and streams of molten material in the transition zone facilitate heat transfer to the molten bath, and whereby the transition zone minimises heat loss from the vessel via the aide walls in contact with the transition zone.

A preferred form of the HIsmelt process is characterized by foxing the transition zone by injecting carrier gas, metalliferous feed material, solid carbonaceous material, and optionally fluxes into the bath through lances that extend downwardly and inwardly through side walls of the vessel so that the carrier gas and the solid material penetrate the metal layer and cause molten material to be projected from the bath.

This form of the HIsmelt process is an improvement over earlier forms of the process which form the transition zone by bottom injection of carrier gas and solid carbonaceous material through tuyeres into th bath which causes droplets and splashes and streams of molten material to be projected from the bath.

The applicant has carried out extensive pilot plant work on operating the HIsmelt process with continuous discharge of molten iron and periodic tapping of molten slag from the direct smelting vessel and has made a series of significant findings in relation to the process.

One of the findings, which is the subject of a first aspect of the present invention, is that in situations where there is a continuing supply of oxygen-containing gas and solid carbonaceous material it is possible to hold the process indefinitely, ie stop producing metal, and maintain a pool of molten metal in the vessel, and then continue operating the process and resume metal production.

This is an important finding because there are a number of situations in which it is important to be able to stop production of molten iron for relatively short periods of time. One example of such a situation is when downstream operations can not take molten iron produced by the process. In this situation, whilst the process can continue to operate and produce molten iron, there is a cost penalty associated with not being able to use the molten iron immediately in the downstream processing operations. Another example is where there is an unforseen interruption to the supply of metalliferous feed material to the process and it is not possible to continue operating the process. In such situations, without a hold procedure, the only option is to immediately shut-down the process and empty molten iron and slag from the vessel and then restart the process when the cause of the shutdown has been rectified. A process shutdown/start-up is a major exercise with considerable lost production and cost.

Another of the findings in the pilot plant work, which is the subject of a second aspect of the present invention, is that in situations where there has been an interruption to the supply of solid carbonaceous material but there is an available supply of gaseous or liquid combustible material, such as natural gas, it is possible to hold the process for a considerable period of time, ie stop producing metal, and maintain a pool of molten metal in the vessel, and then continue operating the process and resume metal production.

This is an important finding because, in such a situation, without a hold procedure, the only option is to immediately shut-down the process and empty molten iron and slag from the vessel and then restart the process when the cause of the shutdown has been rectified. A process shutdown/start-up is a major exercise with considerable lost production and cost.

The above findings are applicable particularly to direct smelting processes which discharge molten metal continuously and tap molten slag periodically.

SUMMARY OF THE INVENTION

The first aspect of the present invention provides a direct smelting process for producing molten metal from a metalliferous feed material in a vessel that contains a molten bath having a metal layer and a slag layer on the metal layer, which process includes the following standard operating procedure of:

(a) injecting carrier gas, metalliferous feed material, and solid carbonaceous material, and optionally fluxes, into the molten bath via a plurality of solid material injection lances/tuyeres positioned above and extending towards the surface of the metal layer and causing molten material to be projected from the molten bath as splashes, droplets and streams into a space above a nominal quiescent surface of the molten bath to form a transition zone;

(b) smelting metalliferous feed material to metal in the molten bath;

(c) injecting oxygen-containing gas into the vessel via one or more than one lance/tuyere and post-combusting reaction gases released from the molten bath, whereby the ascending and thereafter descending splashes, droplets and streams of molten material in the transition zone facilitate heat transfer to the molten bath;

(d) tapping molten metal and molten slag as required from the vessel;

and which process is characterised by the following hold procedure for situations in which it is necessary to stop production of molten metal for a period of time other than situations in which there has been an interruption to the supply of oxygen-containing gas and/or solid carbonaceous material to the process:

(i) stopping supply of metalliferous feed material into the vessel;

(ii) continuing to inject carrier gas and solid carbonaceous material into the molten bath via the solid material injection lances/tuyeres and generating combustible material in the molten bath and causing molten material and combustible material to be projected into the transition zone; and (iii) continuing to inject oxygen-containing gas into the vessel via one or more than one lance/tuyere and combusting combustible material projected into the transition zone, whereby the ascending and thereafter descending splashes, droplets and streams of molten material in the transition zone facilitate heat transfer to the molten bath to maintain the temperature of the molten bath above a temperature at which the bath freezes.

Preferably the amount of solid carbonaceous material and oxygen containing gas that is injected into the vessel is reduced during the hold procedure.

Preferably the hold procedure includes periodically adding fluxes to the molten bath.

Preferably the hold procedure includes periodically tapping of molten slag during the hold period.

The second aspect of the present invention provides a process for producing molten metal from a metalliferous feed material in a vessel that contains a molten bath having a metal layer and a slag layer on the metal layer, which process includes the following standard operating procedure of:

(a) injecting carrier gas, metalliferous feed material, and solid carbonaceous material, and optionally fluxes, into the molten bath via a plurality of solid material injection lances/tuyeres positioned above and extending towards the surface of the metal layer and causing molten material to be projected from the molten bath as splashes, droplets and stream into a apace above a nominal quiescent surface of the molten bath to form a transition zone;

(b) smelting metalliferous feed material to metal in the molten bath;

(c) injecting oxygen-containing gas into the vessel via one or more than one lance/tuyere and post-combusting reaction gases released from the molten bath, whereby the ascending and thereafter descending splashes, droplets and streams of molten material in the transition zone facilitate heat transfer to the molten bath;

(d) tapping molten metal and molten slag as required from the vessel;

and which process is characterised by the following hold procedure for situations in which it is necessary to stop production of molten metal for a period of time and there has been an interruption to the supply of solid carbonaceous material to the process:

(i) stopping supply of metalliferous feed material into the vessel; and (ii) injecting oxygen-containing gas and gaseous or liquid combustible material into the vessel and combusting the combustible material to maintain the temperature.

The term "combustible material" in regard to the first aspect of the invention is understood to include, by way of example, carbon monoxide, solid char, and hydrogen and other volatiles that may be generated from a solid carbonaceous material.

The term "quiescent surface" in the context of the molten bath is understood to mean the surface of the molten bath under process conditions in which there is no gas/solids injection and therefore no bath agitation.

Typically, the hold period of time is up to 5 hours.

Preferably, step (d) of the process includes continuously tapping molten metal from the vessel.

Where the process includes continuously tapping molten metal via a forehearth, preferably the hold procedure includes varying the pressure in the vessel and thereby varying the level of molten metal in the vessel and forcing molten metal from the vessel into the forehearth and from the forehearth into the vessel. Varying the pressure causes circulation of molten metal between the vessel and the forehearth and assists in maintaining a relatively uniform temperature of the molten metal in the vessel and the forehearth.

Preferably the solid carbonaceous material is coal.

Preferably the gaseous combustible material includes natural gas.

Preferably the oxygen-containing gas is air or oxygen-enriched air.

More preferably the oxygen-enriched air contains less than 50% by volume oxygen.

Preferably the process operates at high post-combustion levels.

Preferably the post-combustion levels are greater than 60%.

Preferably, the metalliferous feed material is an iron-containing feed material. The preferred feed material is iron ore.

The iron ore may be pre-heated.

The iron ore may be partially reduced.

Preferably metalliferous feed material is smelted to metal predominantly in the metal layer.

BRIEF DESCRIPTION OF THE DRAWING

The present invention is described further by way of example with reference to the accompanying drawing, FIG. 1 which is a vertical section through a preferred form of a direct smelting vessel for carrying out a preferred embodiment of a process for direct smelting iron ore to molten iron in accordance with the present invention.

DETAILED DESCRIPTION

Figure 1:
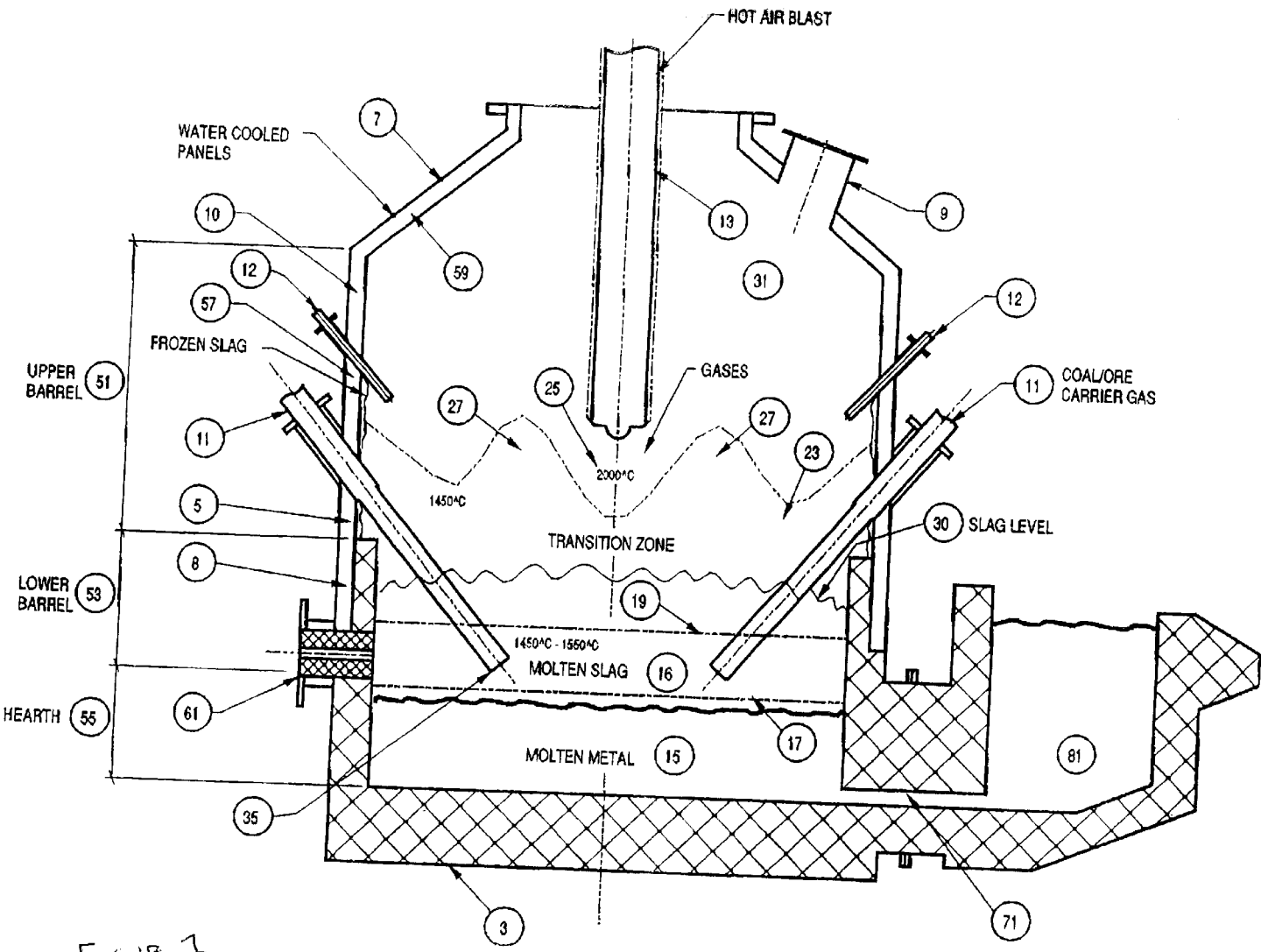

The vessel shown in FIG. 1 has a hearth that includes a base 3 and sides 55 formed from refractory bricks; side walls 5 which form a generally cylindrical barrel extending upwardly from the sides 55 of the hearth and which include an upper barrel section 51 and a lower barrel section 53; a roof 7; an outlet 9 for off-gases; a forehearth 81 which can discharge molten iron continuously; a forehearth connection 71 that interconnects the hearth and the forehearth 81; and a tap-hole 61 for discharging molten slag.

In use, under standard operating (ie steady-state) conditions, the vessel contains a molten bath of iron and slag which includes a layer 15 of molten iron and a layer 16 of molten slag on the metal layer 15. The arrow marked by the numeral 17 indicates the position of the nominal quiescent surface of the metal layer 15 and the arrow marked by the numeral 19 indicates the position of nominal quiescent surface of the slag layer 16. The term "quiescent surface" is understood to mean the surface when there is no injection of gas and solids into the vessel.

The vessel also includes 2 solids injection lances/tuyeres 11 extending downwardly and inwardly at an angle of 30–60° to the vertical through the side walls 5 and into the slag layer 16. The position of the lances/tuyeres 11 is selected so that the lower ends are above the quiescent surface 17 of the metal layer 15 under steady-state process conditions.

In use, under standard operating conditions iron ore, solid carbonaceous material (typically coal), and fluxes (typically lime and magnesia) entrained in a carrier gas (typically $N_2$) are injected into the molten bath via the lances/tuyeres 11. The momentum of the solid material/carrier gas causes the solid material and gas to penetrate the metal layer 15. The coal is devolatilised and thereby produces gas in the metal layer 15. Carbon partially dissolves into the metal and partially remains as solid carbon. The iron ore is smelted to metal and the smelting reaction generates carbon monoxide gas. The gases transported into the metal layer 15 and generated via devolatilisation and smelting produce significant buoyancy uplift of molten metal, solid carbon, and slag (drawn into the metal layer 15 as a consequence of solid/gas/injection) from the metal layer 15 which generates an upward movement of splashes, droplets and streams of molten material, and these splashes, and droplets, and streams entrain slag as they move through the slag layer 16.

The buoyancy uplift of molten metal, solid carbon and slag causes substantial agitation in the metal layer 15 and the slag layer 16, with the result that the slag layer 16 expands in volume and has a surface indicated by the arrow 30. The extent of agitation is such that there is reasonably uniform temperature in the metal and the slag regions—typically, 1450–1550° C. with a temperature variation of the order of 30°.

In addition, the upward movement of splashes, droplets and streams of molten metal and slag caused by the buoyancy uplift of molten metal, solid carbon, and slag extends into the top space 31 above the molten material in the vessel and:

(a) forms a transition zone 23; and (b) projects some molten material (predominantly slag) beyond the transition zone and onto the part of the upper barrel section 51 of the side walls 5 that is above the transition zone 23 and onto the roof 7.

In general terms, the slag layer 16 is a liquid continuous volume, with gas bubbles therein, and the transition zone 23 is a gas continuous volume with splashes, droplets, and streams of molten metal and slag.

The vessel further includes a lance 13 for injecting an oxygen-containing gas (typically preheated oxygen enriched air) which is centrally located and extends vertically downwardly into the vessel. The position of the lance 13 and the gas flow rate through the lance 13 are selected so that under standard operating conditions the oxygen-containing gas penetrates the central region of the transition zone 23 and maintains an essentially metal/slag free space 25 around the end of the lance 13.

In use, under standard operating conditions, the injection of the oxygen-containing gas via the lance 13 post-combusts reaction gases CO and $H_2$ in the transition zone 23 and in the free space 25 around the end of the lance 13 and generates high temperatures of the order of 2000° C. or higher in the gas space. The heat is transferred to the ascending and descending splashes, droplets, and streams, of molten material in the region of gas injection and the heat is then partially transferred to the metal layer 15 when the metal/slag returns to the metal/slag layers 15/16.

The free space 25 is important to achieving high levels of post combustion because it enables entrainment of gases in the space above the transition zone 23 into the end region of the lance 13 and thereby increases exposure of available reaction gases to post combustion.

The combined effect of the position of the lance 13, gas flow rate through the lance 13, and upward movement of splashes, droplets and streams of molten material is to shape the transition zone 23 around the lower region of the lance 13—generally identified by the numerals 27. This shaped region provides a partial barrier to heat transfer by radiation to the side walls 5.

Moreover, under standard operating conditions, the ascending and descending droplets, splashes and stream of molten material are an effective means of transferring heat from the transition zone 23 to the molten bath with the result that the temperature of the transition zone 23 in the region of the side walls 5 is of the order of 1450° C.–1550° C.

The vessel is constructed with reference to the levels of the metal layer 15, the slag layer 16, and the transition zone 23 in the vessel when the process is operating under standard operating conditions and with reference to splashes, droplets and streams of molten material that are projected into the top space 31 above the transition zone 23 when the process is operating under steady-state operating conditions, so that:

(a) the hearth and the lower barrel section 53 of the side walls 5 that contact the metal/slag layers 15/16 are formed from bricks of refractory material (indicated by the cross-hatching in the figure);

(b) at least part of the lower barrel section 53 of the side walls 5 is backed by water cooled panels 8; and (c) the upper barrel section 51 of the side walls 5 and the roof 7 that contact the transition zone 23 and the top space 31 are formed from water cooled panels 57, 59.

Each water cooled panel 57, 59 (not shown) in the upper barrel section 51 of the side walls 5 has parallel upper and lower edges and parallel side edges and is curved so as to define a section of the cylindrical barrel. Each panel includes an inner water cooling pipe and an outer water cooling pipe. The pipes are formed into a serpentine configuration with horizontal sections interconnected by curved sections. Each pipe further includes a water inlet and a water outlet. The pipes are displaced vertically so that the horizontal sections of the outer pipe are not immediately behind the horizontal sections of the inner pipe when viewed from an exposed face of the panel, ie the face that is exposed to the interior of the vessel. Each panel further includes a rammed refractory material which fills the spaces between the adjacent straight sections of each pipe and between the pipes. Each panel further includes a support plate which forms an outer surface of the panel.

The water inlets and the water outlets of the pipes are connected to a water supply circuit (not shown) which circulates water at high flow rate through the pipes.

The vessel also includes 2 natural gas burners 12 extending downwardly and inwardly at an angle of 30–60° to the vertical through the side walls 5. As is described hereinafter, the natural gas burners 12 can be used in a hold procedure.

The pilot plant work referred to above was carried out as a series of extended campaigns by the applicant at its pilot plant at Kwinana, Western Australia.

The pilot plant work was carried out with the vessel shown in the figure and described above and in accordance with the steady-state process conditions described above. In particular, the process operated with continuous discharge of molten iron via the forehearth 81 and periodic tapping of molten slag via the tap-hole 61.

The pilot plant work evaluated the vessel and investigated the process under a wide range of different:

(a) feed materials;

(b) solids and gas injection rates;

(c) slag inventories—measured in terms of the depth of the slag layer and the slag:metal ratios;

(d) operating temperatures; and (e) apparatus set-ups.

In the context of the present invention it was found in the pilot plant work that is was possible to hold the process for up to 5 hours with a pool of molten metal in the vessel and to re-start the process at the end of the hold period. This finding is significant in terms of providing a process that is flexible and can minimise shut-downs of the process.

The applicant found that the following hold procedures worked successfully.

1. Situations in which there is an interruption to the supply of the oxygen-containing gas.

The hold procedure includes the following steps.

(a) Stop supply of all feed materials to the vessel, other than maintaining a low positive flow of carrier gas to lances/tuyeres 11.

(b) Drain slag from the vessel to a point at which there is a relatively small layer of slag on the metal layer 15.

(c) Allow the slag to freeze on the metal layer 15.

(d) Add charcoal to the forehearth 81 and stop spray cooling of the external surface of the forehearth connection 71.

The applicant found that this procedure maintains the metal in the vessel in a molten state for greater than 6 hours. In this context, the forehearth 81 is a more exposed area than the vessel and it is necessary to monitor the state of the molten metal and take steps (such as adding extra charcoal to the forehearth surface) to insulate the metal to reduce heat loss.

Once the supply of oxygen-containing gas has been restored, the direct smelting process can be re-started.

2. Situations in which there is a continuing supply of oxygen-containing gas and solid carbonaceous material and it is otherwise necessary to hold metal production.

(a) In the specific situation where there is continuing supply of feed materials to the vessel but it is necessary to stop production of molten. iron, the hold procedure includes the following steps:

(i) Stop supplying iron ore to the vessel.

(ii) Continue supplying solid carbonaceous material at a reduced amount and carrier gas via the lances/tuyeres 11 and thereby generate upward movement of splashes, droplets and streams of molten material and solid carbon into the transition zone. The molten material is projected onto the water cooled panels, and forms solid layers predominantly formed from slag that minimise heat lose via the panels.

(iii) Continue to inject oxygen-containing gas at a reduced amount via the lance 13 and combust material in the transition zone. The descending splashes, droplets and streams of molten material transfer heat to the molten bath.

(iv) Add extra charcoal to the forehearth 81 and stop spray cooling of the external surface of the forehearth connection.

(v) increase pressure in the vessel to a pre-set upper limit in a series of steps over a time interval.

(vi) Decrease pressure in the vessel to a pre-set lower limit in a series of steps over a time interval.

(vii) Repeat steps (v) and (vi) and sample the forehearth temperature and carbon periodically.

(viii) Periodically tap slag.

The purpose of varying the pressure is to pulse molten metal from the vessel into the forehearth 81 and from the forehearth 81 into the vessel to circulate molten metal through both regions. The circulation of molten metal ensures that there is relatively uniform temperature of the molten metal and avoids local freezing of the metal.

(b) In the specific situation where there is a loss of coal feed but continuing supply of other feed material, the hold procedure includes the following steps:

(i) Stop supplying iron ore to the vessel and maintain a positive flow of carrier gas into the vessel via the solids injection lances/tuyeres 11;

(ii) Decrease the flow rate of the oxygen-containing gas via the lance 13 to a lower flow rate and inject natural gas into the vessel via the burners 12. The natural gas combusts in the vessel and generates heat that maintains the temperature within the vessel.

(iii) Add extra charcoal to the forehearth 81 and stop spray cooling of the forehearth outlet.

(iv) Increase pressure in the vessel to a pre-set upper limit in a series of steps over a time interval.

(v) Decrease pressure in the vessel to a pre-set lower limit in a series of steps over a time interval.

(vi) Repeat steps (iv) and (v) and sample the forehearth temperature and carbon periodically.

Depending on the estimated time before coal feed can be re-established, it may be appropriate to reduce the amounts of molten metal and slag in the vessel to minimum levels.

Once coal supply has been re-established the preferred start-up procedure is to heat and carburise the molten metal to approximately 1450° C. and saturated carbon and then ram up feed material supply.

Many modifications may be made to the preferred embodiments of the process of the present invention as described above without departing from the spirit and scope of the present invention.

What is claimed is:

1. A process for producing molten metal from a metalliferous feed material in a vessel that contains a molten bath having a metal layer and a slag layer on the metal layer, the process comprising:

(a) injecting carrier gas, metalliferous feed material, and solid carbonaceous material, and optionally fluxes, into the molten bath via a plurality of solid material injection lances/tuyeres positioned above and extending towards the surface of the metal layer and causing molten material to be projected from the molten bath as splashes, droplets and streams into a space above a nominal quiescent surface of the molten bath to form a transition zone;

(b) smelting metalliferous feed material to metal in the molten bath;

(c) injecting oxygen-containing gas into the vessel via one or more than one lance/tuyere and post-combusting reaction gases released from the molten bath, whereby the ascending and thereafter descending splashes, droplets and streams of molten material in the transition zone facilitate heat transfer to the molten bath;

(d) tapping molten metal and molten slag as required from the vessel; and (e) a hold procedure for situations in which it is necessary to stop production of molten metal for a period of time other than situations in which there has been an interruption to the supply of oxygen-containing gas and/or solid carbonaceous material to the process, the hold procedure comprises:

(i) stopping supply of metalliferous feed material into the vessel;

(ii) continuing to inject carrier gas and solid carbonaceous material into the molten bath via the solid material injection lances/tuyeres and generating combustible material in the metal layer and causing molten material and combustible material to be projected into the transition zone; and (iii) continuing to inject oxygen-containing gas into the vessel via one or more than one lance/tuyere and combusting combustible material projected into the transition zone, whereby the ascending and thereafter descending splashes, droplets and streams of molten material in the transition zone facilitate heat transfer to the molten bath to maintain the temperature of the molten bath above a temperature at which the bath freezes.

2. The process defined in claim 1 wherein the hold period of time is up to 5 hours.

3. The process defined in claim 1 wherein step (d) includes continuously tapping molten metal from the vessel.

4. The process defined in claim 1 wherein step (d) includes continuously tapping molten metal from the vessel via a forehearth and the hold procedure includes varying the pressure in the vessel and thereby varying the level of molten metal in the vessel and forcing molten metal from the vessel into the forehearth and from the forehearth into the vessel.

5. The process defined in claim 4 wherein the amount of solid carbonaceous material and oxygen containing gas that is injected into the vessel is reduced during the hold procedure.

6. The process defined in claim 4 wherein the hold procedure includes periodically adding fluxes to the molten bath.

7. The process defined in claim 1 wherein the solid carbonaceous material is coal.

8. The process defined in claim 1 wherein the hold procedure includes periodically tapping molten slag during the hold period.

9. A process for producing molten metal from a metalliferous feed material in a vessel that contains a molten bath having a metal layer and slag layer on the metal layer, the process comprising.:

(a) injecting carrier gas, metalliferous feed material, and solid carbonaceous material, and optionally fluxes, into the molten bath via a plurality of solid material injection lances/tuyeres positioned above and extending towards the surface of the metal layer and causing molten material to be projected from the molten bath as splashes, droplets and streams into a space above a nominal quiescent surface of the molten bath to form a transition zone;

(b) smelting metalliferous feed material to metal in the molten bath;

(c) injecting oxygen-containing gas into the vessel via one or more than one lance/tuyere and post-combusting reaction gases released from the molten bath, whereby the ascending and thereafter descending splashes, droplets and streams of molten material in the transition zone facilitate heat transfer to the molten bath;

(d) tapping molten metal and molten slag as required from the vessel; and (e) a hold procedure for situations in which it is necessary to stop production of molten metal for a period of time and there has been an interruption to the supply of solid carbonaceous material to the process, the hold procedure comprises:

(i) stopping supply of metalliferous feed material into the vessel; and (ii) injecting oxygen-containing gas and gaseous or liquid combustible material into the vessel and combusting the combustible material to maintain the temperature.

10. The process defined in claim 9 further includes decreasing the flow rate of oxygen-containing gas from the flow rate for the standard operating procedure to a lower rate that is consistent with the hold procedure.

11. The process defined in claim 9 wherein the combustible material supplied to the vessel in step (e) (ii) includes natural gas.

12. The process defined in claim 9 wherein the hold period of time is up to 5 hours.

13. The process defined in claim 9 wherein step (d) includes continuously tapping molten metal from the vessel.

14. The process defined in claim 9 wherein step (d) includes continuously tapping molten metal from the vessel via a forehearth and the hold procedure includes varying the pressure in the vessel and thereby varying the level of molten metal in the vessel and forcing molten metal from the vessel into the forehearth and from the forehearth into the vessel.

15. The process defined in claim 9 wherein the hold procedure includes maintaining a positive pressure of carrier gas injection via the solids injection lances/tuyeres.

16. A process for producing molten metal from a metalliferous feed material in a vessel that contains a molten bath having a metal layer and a slag layer on the metal layer, the process comprising:

(a) injecting carrier gas, metalliferous feed material, and solid carbonaceous material, and optionally fluxes, into the molten bath via a plurality of solid material injection lances/tuyeres positioned above and extending towards the surface of the metal layer and causing molten material to be projected from the molten bath as splashes, droplets and streams into a space above a nominal quiescent surface of the molten bath to form a transition zone;

(b) smelting metalliferous feed material to metal in the molten bath;

(c) injecting oxygen-containing gas into the vessel via one or more than one lance/tuyere and post-combusting reaction gases released from the molten bath, whereby the ascending and thereafter descending splashes, droplets and streams of molten material in the transition zone facilitate heat transfer to the molten bath;

(d) continuously tapping molten metal from the vessel via a forehearth;

(e) tapping molten slag as required from the vessel;

(f) a hold procedure for situations in which it is necessary to stop production of molten metal for a period of time other than situations in which there has been all interruption to the supply of oxygen-containing gas and/or solid carbonaceous material to the process, the hold procedure comprises:

(i) stopping supply of metalliferous feed material into the vessel;

(ii) continuing to inject carrier gas and solid carbonaceous material into the molten bath via the solid material injection lances/tuyeres and generating combustible material in the metal layer and causing molten material and combustible material to be projected into the transition zone; and (iii) continuing to inject oxygen-containing gas into the vessel via one or more than one lance/tuyere and combusting combustible material projected into the transition zone, whereby the ascending and thereafter descending splashes, droplets and streams of molten material in the transition zone facilitate heat transfer to the molten bath to maintain the temperature of the molten bath above a temperature at which the bath freezes; and (iv) varying the pressure in the vessel and thereby varying the level of molten metal in the vessel and forcing molten metal from the vessel into the forehearth and from the forehearth into the vessel.

17. A process for producing molten metal from a metalliferous feed material in a vessel that contains a molten bath having a metal layer and a slag layer on the metal layer, the process comprising:

(a) injecting carrier gas, metalliferous feed material, and solid carbonaceous material, and optionally fluxes, into the molten bath via a plurality of solid material injection lances/tuyeres positioned above and extending towards the surface of the metal layer and causing molten material to be projected from the molten bath as splashes, droplets and streams into a space above a nominal quiescent surface of the molten bath to form a transition zone;

(b) smelting metalliferous feed material to metal in the molten bath;

(c) injecting oxygen-containing gas into the vessel via one or more than one lance/tuyere and post-combusting reaction gases released from the molten bath, whereby the ascending and thereafter descending splashes, droplets and streams of molten material in the transition zone facilitate heat transfer to the molten bath;

(d) continuously tapping molten metal from the vessel via a forehearth;

(e) tapping molten slag as required from the vessel;

(f) a hold procedure for situations in which it is necessary to stop production of molten metal for a period of time and there has been an interruption to the supply of solid carbonaceous material to the process, the hold procedure comprises:

(i) stopping supply of metalliferous feed material into the vessel;

(ii) injecting oxygen-containing gas and gaseous or liquid combustible material into the vessel and combusting the combustible material to maintain the temperature;

(iii) varying the pressure in the vessel and thereby varying the level of molten metal in the vessel and forcing molten metal from the vessel into the forehearth and from the forehearth into the vessel.

* * * * *